United States Patent [19]

Magni et al.

[11] 4,381,186

[45] Apr. 26, 1983

[54] PROCESS FOR DYEING POLYAMIDIC TEXTILE MATERIALS, IN PARTICULAR HIGH DYEING SPEED POLYAMIDES WITH ACID DYES AND ALKALINE REACTANTS

[75] Inventors: Eugenio Magni, Busto Arsizio; Claudio Pernetti, Milan, both of Italy

[73] Assignee: Snia Viscosa Societa' Nazionale Industria Applicazioni Viscosa SpA, Milan, Italy

[21] Appl. No.: 244,923

[22] Filed: Mar. 18, 1981

[30] Foreign Application Priority Data

Mar. 19, 1980 [IT] Italy ..... 20782 A/80

[51] Int. Cl.[3] ..... D06P 3/06; D06P 1/67

[52] U.S. Cl. ..... 8/620; 8/680; 8/924; 8/929

[58] Field of Search ..... 8/620, 680, 924, 929

[56] References Cited

U.S. PATENT DOCUMENTS

| | | | |
|---|---|---|---|
| 3,281,201 | 10/1966 | Mautner et al. | 8/620 |
| 3,980,428 | 9/1976 | Fabbri et al. | 8/578 |
| 4,063,877 | 12/1977 | Elliot et al. | 8/917 |
| 4,252,531 | 2/1981 | Daeuble et al. | 8/531 |

FOREIGN PATENT DOCUMENTS

| | | |
|---|---|---|
| 716990 | 10/1954 | United Kingdom . |
| 1574841 | 9/1980 | United Kingdom . |
| 1574842 | 9/1980 | United Kingdom . |

*Primary Examiner*—A. Lionel Clingman

*Attorney, Agent, or Firm*—Wenderoth, Lind & Ponack

[57] ABSTRACT

A process is described for the fast dyeing of textile materials constituted, at least to a significant degree, by polyamides, in particular quick dyeing polyamides, characterized in that a dye bath is employed comprising acid dyes to which a combination of reagents (e.g. ammonium sulphate and caustic soda) is added that is adapted to impart to the bath an initial alkaline pH and to lower the pH by elimination of volatile bases, at least at the final heating temperatures, and in that the bath is heated until final temperatures between 60° C. and 80° C. are attained.

17 Claims, 1 Drawing Figure

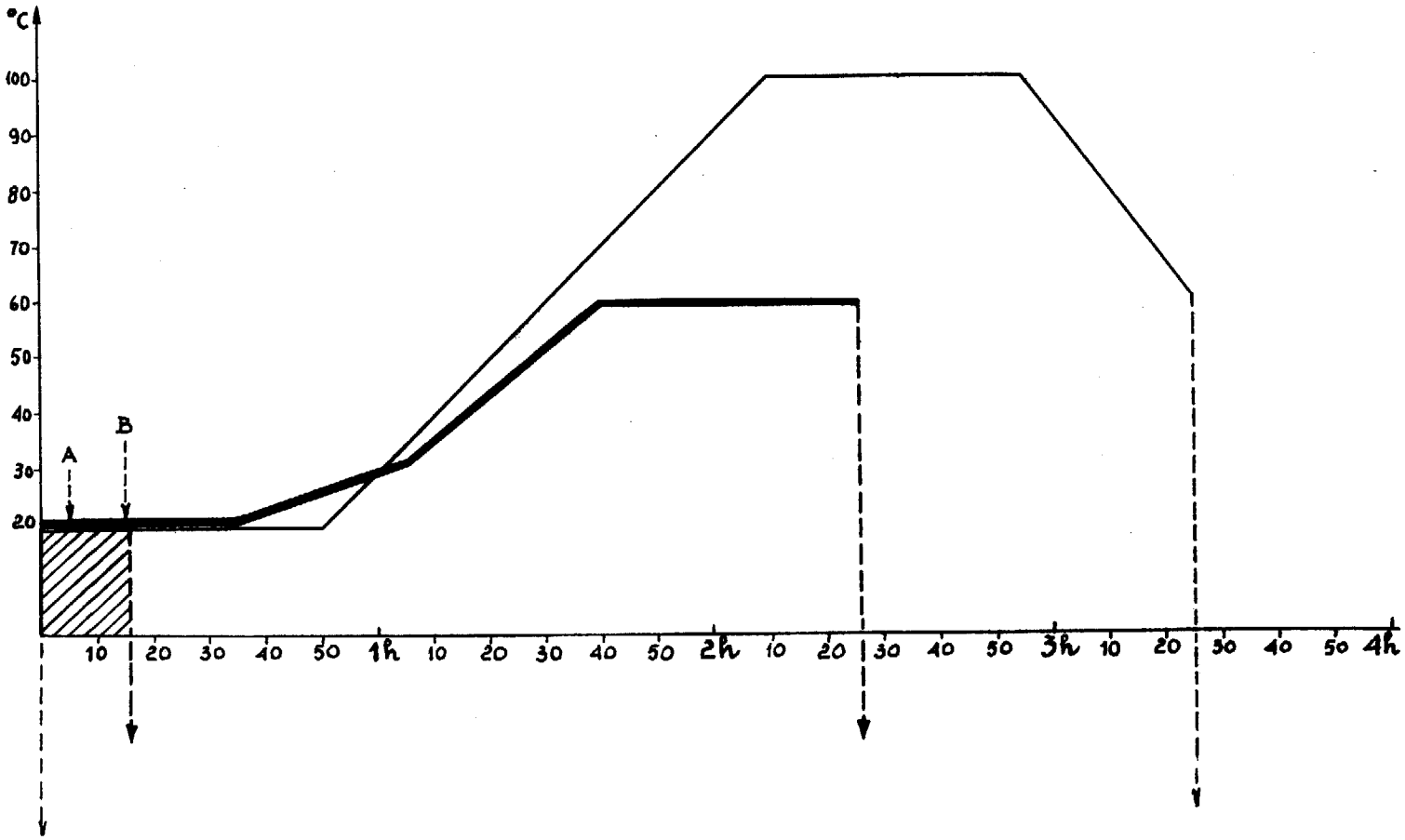
°C
100
90
80
70
60
50
40
30
20
A
B
10
20
30
40
50
1h
10
20
30
40
50
2h
10
20
30
40
50
3h
10
20
30
40
50
4h

PROCESS FOR DYEING POLYAMIDIC TEXTILE MATERIALS, IN PARTICULAR HIGH DYEING SPEED POLYAMIDES WITH ACID DYES AND ALKALINE REACTANTS

BACKGROUND OF THE INVENTION

The object of the present invention is a process for dyeing textile materials constituted by polyamides, in particular quick dyeing polyamides.

Particular reference is made herein to polyamide 6 or nylon 6 (polycapronamide), but the invention is applicable to other types of polyamides, such as e.g. polyamide 66 or nylon 66 (polyhexamethyleneadipamide) provided that they are quick dyeing.

What is meant by "quick dyeing polyamides" will be specified hereinafter.

As is known, a good dyeing of textile materials requires that the phenomena connected with the dyeing, such as the dye take-up by, and the migration of the dyes in the fibre of the material, occur in an optimal way. Said phenomena are influenced by a considerable number of variants, such as the nature of the material to be dyed, the composition of the dye bath, with respect to the dyestuffs and to other substances it may contain, temperature diagram of the dyeing process, the duration of its several stages, and so forth. Obviously it would also be possible, from a theoretical viewpoint, to obtain a good dyeing by controlling all the relevant factors at every moment of the process. But it is obviously impossible to do this on an industrial scale, because it would be necessary to program and control at every instant, with precision and delicacy, a series of factors, which would imply the adoption of different processes for each particular dyeing case and the detailed control of each process unit. It is therefore necessary to adopt processes which are as generally applicable as possible, viz. which are suitable, without variations, for dyeing the broadest possible range of textile materials. By particular reference to the polyamides, and specifically to polyamide carpet and rugs to which invention particularly, though not exclusively, refers, the art teaches that it it possible to adopt a general process which comprises a heating to high temperature, on the order of about 100° C., because the fact that such temperatures are attained and maintained for a sufficient time at the end of the process, eliminates all the irregularities which may have intervened in the preceding stages. Thus, if in a certain stage different dyestuffs of the dyestuff mixture employed are taken up by the fiber or migrate therein with different speeds, the final high temperature stage equalizes their absorption and migration at least if suitably compatible dyestuffs are used. However, said high temperature dyeing process, which is normally adopted, has general drawbacks and particular drawbacks with reference to quick dyeing textiles. General drawbacks are essentially, on the one hand, substantial consumptions of heat and on the other, defects in the dyed fabric, especially when the piece winch dyeing process is used. In said process, which is often though not exclusively used and to which preferably, though not exclusively, the present invention refers, the carpet is kept in motion in the dye bath by means of a winch which rotates at a high, predetermined speed. In the dye bath the carpet is disposed in a series of folds which generate creases leading to the formation of corresponding marks (called, in the slang of the art, "stick marks"), due to the wet treatment at high temperature which produces a setting of the synthetic fibres, as is well known to persons skilled in the art.

Another drawback of the high temperature dyeing process is the length of its cycle, which comprises a long, slow heating stage up to 100° C., a more or less long stage at 100° C., and a slow, final cooling to 60° C. In addition to these general drawbacks, it has been found that when quick dyeing polyamides are used, the dyed material may not become uniformly colored.

Low temperature processes are also known. However, none of them has proved satisfactory. It is found that the elimination of the high temperature leads to disuniformity in the absorption and migration of the dyestuffs and to an insufficient utilization thereof, or low dye yield, which it has been vainly attempted to eliminate by adding chemical dyeing aids to the dye bath. E.g., it has been proposed (CHEMIEFASERN-/TEXTILINDUSTRIE Pag. E32, E33—MARCH 1979) to add to the dye bath ammonium thiocyanate together with decyl alcohol as wetting agent, but the results are not satisfactory, and further, the ammonium thiocyanate is somewhat dangerous because it is toxic and therefore is ecologically and operationally disadvantageous under the process condition, and the decyl alcohol leaves a persistent aromatic odor in the dyed materials. Other low temperature dyeing processes involve the use of different dyestuffs having different capacities of migration in the fiber in different stages of the process, but, as has been said, it is extremely undesirable from all viewpoints to adopt process which requires changing the composition of the bath in the course of the dyeing.

SUMMARY OF THE INVENTION

A purpose of this invention is to provide a process which eliminates all the defects of the high temperature dyeing process, viz. both the general defects and those which specifically refer to quick dyeing polyamides, and which at the same time does not require modifications of the bath during the processing but merely requires the control of the temperature diagram (such a control, of course, is necessary in any process). The process of the invention is particularly applicable in connection with winch dyeing, but is generally applicable no matter what the mechanical dyeing system used. The expression "quick dyeing polyamides" is employed to designate polyamides which will give the results hereinafter specified when subjected to the following dyeing test.

The dyeing test is carried out by weighing 5 g of fiber and dyeing them as follows: —a dye bath is prepared at 20° $C_4$ with C.I. acid blue 280 at the standard 1/1 intensity (example: 2% Blue Nylosan N-5GL 200%—Sandoz—), with pH=6 buffered (example: about 2.5 g/lt monosodium phosphate and 0.5 g/lt bisodium phosphate), and R.B.—1:60 by using demineralized water. "R.B." indicates the bath ratio, viz. the ratio of the amount in grams of the material to be dyed to the amount in cc of the dye bath (example: R.B.=1:60-5 g of fiber and 300 cc of dye bath).

The material to be dyed is introduced into the dye bath thus prepared and remains therein under constant stirring for 10 min at 20° C. Thereafter the dye bath is slowly and gradually heated during 40 min (thermic heating gradient 1° C./min) to 60° C. and is maintained for 60 min at the constant temperature of 60° C.

All the fibers which, when subjected to the aforesaid test, cause a nearly complete exhaustion of the dye bath, viz. a concentration of dyestuffs therein at the end of the dyeing which is not higher than 10% of the initial concentration, are called "quick dyeing fibers".

Polycapronamide, or polyamide 6, or nylon 6, commercially used for manufacturing carpets is normally a quick dyeing polyamide.

Another purpose of the present invention it to provide a process which has all the aforesaid features and which provides a complete exhaustion of the dye bath and a migration speed of the dyestuffs in the fibre which is uniform in time, whereby a uniform, solid and evenly penetrating color is obtained.

Another purpose of the present invention is to provide a process of the aforesaid kind, which can be carried into practice by using equipment which is readily available and widely used, and which involves a low cost of reagents and which is therefore economically advantageous.

The process according to the invention is characterized in that an acid dye bath is used to which a combination or reagents is added, preferably in the cold, which combination of reagents is adapted to impart to the bath an initial alkaline pH and to lower said pH through the elimination of volatile bases, at least at the final heating temperatures, and in that the bath is heated until it reaches final temperatures between 60° C. and 80° C.

Preferably the initial pH of the bath is comprised between 8 and 9.5 and it decreases, in the course of the heating, by 0.5–0.9. It is seen therefore that the bath may approach neutrality but never become acid, except in the case of very intense dyeing, in which case it may be necessary (especially when dyeing fibers which can be considered as somewhat slow dyeing on the basis of the previously described test), to add a small amount of diluted organic acid, e.g. acetic acid, towards the end of the dyeing, e.g. at the maximum temperature, completely to exhaust the dye bath.

The combination of reagents employed comprises at least two reagents chosen from among alkalies, salts and acids, at least one of the reagents being a volatile base or being adapted to evolve a volatile base at the temperatures attained in the course of the process.

An example of such a combination of reagents is constituted by caustic soda and ammonium sulphate. General examples are combinations of alkali hydrates and ammonium salts or inorganic and organic acids.

It has been surprisingly found that the process according to the invention permits one to obtain a perfect dyeing without having to adjust the dye bath in the course of the process. It eliminates all the drawbacks of the high temperature process and of the already known low temperature processes for dyeing quick dyeing polyamides.

DETAILED DESCRIPTION OF THE PREFERRED EMBODIMENTS

Additionally, besides the aforesaid results, the process according to the invention provides a surprising progress, in that, in spite of the use of the relatively low temperature used, it considerable increases the dyeing speed and therefore reduces the duration of the dyeing cycle, with respect to conventional processes. This not only increases the energy saving beyond that deriving from the lower temperatures, but also permits a better exploitation of apparatus and manpower. Such a surprising result will be graphically illustrated hereinafter. Further, also surprisingly, the dye bath becomes completely exhausted in spite of the use of lower temperatures. Complete dyeing uniformity, solidity an regularity are achieved. The defects which the high temperature process generates in the fabric, such as the stick marks, are eliminated. The overall progress due to the process according to the invention is therefore very considerable and is achieved with a simplicity of means and economy of reagents.

As to the dyes, the acid dyestuffs already known for dyeing polyamide fibers can be used. The following dyestuffs listed in Colour Index C.I. are indicated as examples: as red element, C.I. acid red 57: red Nailamide EP—ACNA, red Tectilon 3B—Ciba Geigy, red Nylomine B-3B—ICI, red Novanyl L3GP—Yorkshire, red Nylosan C-BL—Sandoz, red Dimacide N-2BL—Ugine Kuhlmann; as blue element, C.I. acid blue 72: blue Acidol BE—BASF, blue Tectilon R—Ciba Geigy, blue Novanyl L-FG—Yorkshire, blue Nylosan C-GL—Sandoz; as yellow element, C.I. acid yellow 219: yellow Tectilon 4R—Ciba-Ceigy, yellow Nylosan C-RM—Sandoz, yellow Nylantrene B4RK—Althouse, or as an alternative, for light and medium-light shades, Yellow Nylantrene B4RC-Althouse (no C.I. reference), or C.I. acid yellow 135: Yellow Nylomine AG—ICI, yellow Telon light NL—Bayer 4; for from medium to dark shades, C.I. acid orange 156: orange Nylosan C-GNS; and as an alternative to the previously mentioned and for particularly difficult shades, for example grey and green: C.I. acid yellow 199: yellow Nylomine A4R.

Dyestuffs other than those exemplified may, of course, be used.

It is to be noted that when a combination of dyestuffs is required, these should be chosen so as to be mutually compatible. It has been surprisingly found that, as a general rule, the pairs or triplets of dyestuffs which are compatible for high temperature dyeing, are also compatible for dyeing by the process of the invention. It is not to be ruled out, however, that variations or adjustments may have to be made in the association of several dyes, which a person skilled in the art can effect based on simple empirical checks.

The specific amounts of caustic soda and ammonium sulphate, or other bases and salts to be used in the process of the invention, depends on the specific concentration of said reagents and on the characteristics of the water employed in the dye bath. Said amounts must be such as to guarantee the required initial alkaline pH. Indicatively, in a bath in which water purified by passage on ion exchange resins, or dehardened water, is used, 0.3 g/lt of ammonium sulphate and 0.5 cc/lt of 36° Bè caustic soda may be used for an initial pH of 9.5, which is preferred in the dye baths for obtaining very light and light shades. For light and medium light shades, an initial pH of 9 is preferred, which may be obtained e.g. with about 0.3 g/lt of ammonium sulphate and 0.4 cc/lt of 36° Bè caustic soda. In general, the darker the desired hues, the lower the initial pH of the bath should be, and the ratio of ammonium sulphate to caustic soda will be varied accordingly. E.g., for a pH of 8.5, preferred for medium and medium dark shades, 0.5 g/lt of ammonium sulphate and about 0.2 cc/lt of 36° Bè caustic soda may be used. For a pH of 8, preferred for dark and very dark shades, the amounts of ammonium sulphate and 36° Bè caustic soda are respectively 0.5 gl/lt and 0.12 cc/lt.

In the process of the present invention it is advantageous to use dyeing aids which are anionic and cationic levelling agents. The use of such levelling agents is well known in the art, so that no further explanation with respect thereto will be given. By way of illustration, examples of levelling agents useful in the process of the present invention, are: anionic products: Sandogene CN produced by Sandoz, Agent Atsa B produced by Althouse, Univadina PS produced by Ciba Geigy; cationic products: Matexil LC-CWL produced by ICI, Sandogene NH or RD produced by Sandoz. The use of other similar commercial products is of course not ruled out.

A preferred embodiment of the process according to the invention consists in the following sequence of the operations. The required volume of dye bath is prepared in the cold (at a temperature of about 20° C.) and the bath circulation pumps are started. Then the diluted caustic caustic soda and the anionic and cationic levelling agents are added. Subsequently the chosen dyestuffs and the ammonium sulphate, in the amounts predetermined to obtain the desired bath composition, are rapidly added. The dyestuffs and the ammonium sulphate have previously been dissolved in a suitable vessel. After the addition of said components, the bath is circulated for about 3–4 min in order to homogenize it completely. The pH is checked, and if required is corrected to the desired value by a further addition of ammonium sulphate or caustic soda, according to cases. Once the desired pH has been attained, the textile material, e.g. grey carpet, is introduced into the dye bath. The dyeing is begun by rotating the carpet for at least 10 min at a high speed in the cold or at room temperature, and thereafter at a diminished speed for a total dyeing time in the cold of 20 min. The heating of the bath is begun with a thermal gradient of about 0.33° C./min so as to attain 30° C. in half an hour. Subsequently the heating speed is increased to a thermal gradient of 1° C./min so as to attain a final maximum temperature of 60° C. in a further half hour approximately. The carpet is rotated in the dye bath at 60° C. for about 45 min, at the end of which period a check of the pH shows that it has decreased by an amount ($\Delta pH$) of about 0.9–0.5. Alternatively, all the heating may be carried out at the same temperature gradient, e.g. 1° C./min, the first, slower heating stage being omitted.

The embodiment described refers to the dyeing, according to the invention, of polyamide carpet in piece on a winch. Obviously, the process of the invention can be applied to the dyeing of polyamide articles other than carpets and by the use of different machinery.

It is also not ruled out that the process may be begun at a temperature different from the exemplified and therefore lower or higher that 20° C. and in general substantially different from room temperature. Obviously in such cases the initial pH may undergo a variation. The progress of the dyeing process according to the embodiment of the present invention is illustrated in the diagram of the attached figure, which evidences the shorter dyeing cycle and the lower energy consumption provided by the invention with respect to the conventional dyeing cycle. No significant changes would occur if the heating were carried out entirely with the same temperature gradient and/or if this latter were changed within certain limits, e.g. from 0.5° C./min to 1.5° C./min. It is seen that the process according to the invention achieves its purposes. Thanks to the use of the system constituted by ammonium sulphate and caustic soda or similar bases and salts, a controlled variation pH system is obtained which permits an equal distribution in take-up time and migration speed of the dyestuffs by and in the fiber of the textile material, and a complete exhaustion of the bath and therefore a maximum dye yield. All this occurs at temperatures which reach at the most a maximum of 60° C. with a consequent, evident energy saving and considerable shortened dyeing cycle times.

The following examples illustrate in a non-limitative way a number of embodiments of the process according to the invention.

EXAMPLE 1

Open dyeing on a Bruckner winch a cut-pile carpet constituted by 100% Nylon 6 polyamide staple fiber produced by the Snia Fibre Co., having the following composition: 100% Nylon 6, 6.7 dtex bright antistatic fiber, weight of the carpet (pile-fiber only) 650 g/m$^2$.

Color: very light beige
0.041% yellow Nylanthrene B4RC—Althouse
0.0215% C.I. Acid Red 57—yield 100
0.028% C.I. Acid Blue 72—yield 100
1.5% Sandogene CN—Sandoz
1.5% Matexil LC-CWL—ICI
0.3 g/l Ammonium Sulphate
0.5 cc/l 36° Be Caustic Soda
Starting pH=9.5, Final pH=8.8
Starting temperature 20° C.
Permanence at 20° C. for 20 min
Heating in 30 min to 30° C. and in another 30 min to 60° C.
Permanence for 45 min at 60° C. End of dyeing.
Rinse.

EXAMPLE 2

Open dyeing on a Bruckner winch a cut-pile carpet constituted by 100% Nylon 6 polyamide staple fiber produced by the Snia Fibre Co. having the following composition: carpet 100% Nylon 6 staple fiber prepared with the following blend: 30% Nylon 6, 6.7 dtex bright staple fiber—70% Nylon 6, 20 dtex mat staple fiber. Weight of the carpet (pile-fiber only) 680 g/m$^2$. Color: light grey 0.07% C.I. Acid Yellow 199—yield 100
0.026% C.I. Acid Red 57—yield 100
0.07% C.I. Acid Blue 72—yield 100
1.5% Univadina PS—Ciba Geigy
1.5% Matexil LC-CWL—ICI
0.3 g/l Ammonium Sulphate
0.4 cc/l 36° Bè Caustic Soda
Starting pH=9, Final pH=8.3

The dyeing diagram is the same as in Example 1.

EXAMPLE 3

Rope dyeing on a winch a cut-pile carpet constituted by 100% Nylon 6 polyamide staple fiber produced by Snia Fibre Co., having the following composition: 100% Nylon 6, 9.4 dtex semistaple fiber-weight of the carpet (pile-fiber only) 580 g/m$^2$. Color: medium nut brown.

0.13% C.I. Acid Orange 156—yield 100
0.09% C.I. Acid Red 57—yield 100
0.095% C.I. Acid Blue 72—yield 100
1.5% Sandogene CN—Sandoz
1.5% Sandogene NH—Sandoz
0.3 g/l Ammonium Sulphate
0.4 cc/l 36° Bè Caustic Soda
Starting pH=9, Final pH=−0.3

The dyeing diagram is the same as in Example 1.

EXAMPLE 4

Open dyeing on a Bruckner winch a cut-pile carpet constituted by 100% Nylon 6 polyamide staple fiber produced by the Snia Fibre Co., having the following composition: 100% Nylon 6, 6.7 dtex glossy antistatic staple fiber, weight of the carpet (pile-fiber only) 650 g/m$^2$.

Color: dark red
0.6% C.I. Acid Orange 156—yield 100
1.2% C.I. Acid Red 57—yield 100
0.27% C.I. Acid Blue 72—yield 100
0.5% Sandogene CN—Sandoz
0.5% Matexil LC-CWL—ICI
0.5 g/l Ammonium Sulphate
0.12 cc/l 36° Bè Caustic Soda
Starting pH=8, Final pH=7.5

The dyeing diagram is the same as in Example 1.

The attached figure graphically illustrates the thermal diagram of the preceding examples compared to the thermal diagram of the conventional high temperature process. The processing times in minutes are marked in the abscissae and the temperatures in centigrades are marked in the ordinates.

The initial part of the diagram, in broken lines, represents the cold stage which precedes the introduction of the dye. Said introduction follows, and then a further cold stage takes place. Subsequently, the heating begins, which heating, in these embodiments, is divided into two parts, the first at a low thermal gradient and a second at a higher gradient. Finally there is a final phase at the maximum temperature. It is noted that while the conventional process, although it reaches 100° C., required 3 hours and 25 minutes, the process according to the invention requires only 2 hours and 25 minutes, with a maximum temperature of 60° C. It is understood that the two diagrams refer to the dyeing of the same material, so that the results are comparable, although the process according to the invention, besides the advantages evidenced by the diagram, also provides a qualitatively superior result.

The following examples illustrate the application of the invention by the use of a single temperature gradient in the heating stage.

EXAMPLE 5

Open dyeing on a Bruckner winch a cut-pile carpet constituted by 100% Nylon 6 polyamide staple fiber produced by the Snia Fibre Co., having the following composition: 100% Nylon 6 staple fiber, 6.7 dtex bright antistatic, carpet weight (pile-fiber only) g/m$^2$ 650.

Color: light green
0.2% C.I. Acid Yellow 219—yield 100
0.017% C.I. Acid Red 57—yield 100
0.1% C.I. Acid Blue 72—yield 100
1.5% Sandogene CN—Sandoz
1.5% Matexil LC-CWL—ICI
0.3 g/l Ammonium Sulphate
0.5 cc/l 36° Bè Caustic Soda
Starting pH=9.5, Final pH=8.8
Starting temperature 20° C.
Permanence at 20° C. for 20 min.
Heating in 40 min to 60° C. with heating gradient 1° C./min.
Permanence for 45 min at 60° C. End of dyeing.
Rinse.

EXAMPLE 6

Open dyeing on a Bruckner winch a cut-pile carpet constituted by 100% Nylon 6 polyamide staple fiber produced by the Snia Fibre Co., having the following composition: carpet 100% Nylon 6 staple fiber prepared with the following blend—30% Nylon 6 staple fiber, 6.7 dtex bright—70% Nylon 6 staple fibre, 20 dtex mat. Carpet weight (pile-fibre only) g/m$^2$ 680. Color: olive.

0.76% C.I. Acid Yellow 219—yield 100
0.062% C.I. Acid Red 57—yield 100
0.29% C.I. Acid Blue 72—yield 100
1% Agent ATSA B—Althouse
1% Matexil LC-CWL—ICI
0.5 g/l Ammonium Sulphate
0.2 cc/l 36° Bè Caustic Soda
Starting pH=8.5, Final pH=8.8

The dyeing diagram is the same as in Example 5.

The invention can also be applied in such a way that an initial dyeing bath is used several times with the addition of auxiliary products, caustic soda, and dyestuffs. A suitably modified temperature gradient must be used after the first dyeing and for all successive dyeings, which can usually be up to a maximum of four or five. The said modified diagram is as follows: the carpet is introduced into the bath and is maintained therein at 40° C. for 10 min; the required quantity of ammonium sulphate is then gradually added, e.g. during 20 min; the bath is heated to 60° C., e.g. with a temperature gradient of 1° C./min during 20 min; the bath is maintained at 60° C. for 45 min; and finally the carpet is rapidly removed and rapidly cooled by means of a special mechanical apparatus such as that marketed under the name of Frigofloor by the Bruckner Co. The successive dyeings are so controlled as to produce the same colour shade or darker shades.

Repetitive dyeing does not modify the amount of dyestuffs used, but it permits a savings of auxiliary chemicals. Specifically, for dyeing cycles after the first one, the amount of caustic soda employed is 25% less than that normally used for the specific hue which it is desired to obtain; the amount of ammonium sulphate is 50% less, the amount of anionic levelling agent is 25% less and the amount of cationic levelling agent is 50% less.

The repetitive dyeing process will be illustrated by the following examples:

EXAMPLE 7

Open dyeing on a Bruckner winch a cut-pile carpet constituted by 100% Nylon 6 polyamide staple fiber produced by the Snia Fibre Co., having the following composition: carpet 100% Nylon 6 staple fiber antistatic, prepared from the following blend—70% Nylon 6 staple fiber, 9.4 dtex semibright—30% Nylon 6 staple fiber, 13 dtex semibright—Carpet weight (pile—fiber only) g/m$^2$ 550.

Color: light beige
0.05% C.I. Acid Yellow 219—yield 100
0.01% C.I. Acid Red 57—yield 100
0.018% C.I. Acid Blue 72—yield 100
1.5% Agent ATSA B—Althouse
1.5% Matexil LC-CWL—ICI
0.3 g/l Ammonium Sulphate
0.5 cc/l 36° Bè Caustic Soda
Starting pH=9.5, Final pH=8.8
Starting temperature 20° C.
Permanence at 20° C. for 20 min.

Heating to 60° C. with heating gradient 1° C./min during 40 min.

Permanence at 60° C. for 45 min. End of dyeing.

Extraction of the carpet and cooling thereof by means of Frigofloor apparatus of the Bruckner Co.

Conservation of the exhausted dyeing bath for the following dyeing cycle (Example 8).

EXAMPLE 8

Open dyeing on a Bruckner winch a cut-pile carpet having the same composition as the carpet of Example 7. The dyeing is carried out in the exhausted bath of the preceding dyeing (Example 7).

Color: beige
0.17% C.I. Acid Yellow 219—yield 100
0.045% C.I. Acid Red 57—yield 100
0.047% C.I. Acid Blue 72—yield 100
1.12% Agent ATSA B—Althouse
0.75% Matexil LC-CWL—ICI
0.15 g/l Ammonium Sulphate
0.37 cc/l 36° Bè Caustic Soda
pH after the addition of ammonium sulphate=9.5
Final pH=8.8

Starting temperature 40° C., with the addition of all the products with the exception of the ammonium sulphate in the exhausted bath of the preceding dyeing.

After 10 min at said temperature, slow addition of prescribed amount of ammonium sulphate in about 20 min.

Heating to 60° C. with a temperature gradient of 1° C./min during 20 min.

Permanence at 60° C. for 45 min—End of dyeing.

Extraction of the carpet and cooling thereof with Frigofloor apparatus of the Bruckner Co.

Conservation of the exhausted dyeing bath for the successive dyeing cycles.

EXAMPLE 9

Open dyeing on a Bruckner winch a cut-pile carpet having the same composition of the carpet of Example 7. The dyeing is carried out in the exhausted bath of the preceding dyeing (Example 8).

Color: clear brown
0.3% C.I. Acid Yellow 219—yield 100
0.12% C.I. Acid Red 57—yield 100
0.142% C.I. Acid Blue 72—yield 100
0.75% Agent ATSA B—Althouse
0.5% Matexil LC-CWL—ICI
0.15 g/l Ammonium Sulphate
0.3 cc/l 36° Bè Caustic Soda
pH after adding the ammonium sulphate=9
Final pH=8.3

The diagram and the operations of the dyeing cycle are the same as in Example 8.

EXAMPLE 10

Open dyeing on a Bruckner winch a cut-pile carpet having the same composition as the carpet of Example 7. The dyeing is carried out in the exhausted bath of the preceding dyeing (Example 9).

Color: brown
0.74% C.I. Acid Yellow 219—yield 100
0.24% C.I. Acid Red 57—yield 100
0.25% C.I. Acid Blue 72—yield 100
0.75% Agent ATSA B—Althouse
0.5% Matexil LC-CWL—ICI
0.25 g/l Ammonium Sulphate
0.15 cc/l 36° Bè Caustic Soda
pH after adding the ammonium sulphate=8.5
Final pH=8

The diagram and the dyeing operations are the same as in Example 8.

EXAMPLE 11

Open dyeing on a Bruckner winch a cut-pile carpet having the same composition as the carpet of Example 7. The dyeing is carried out in the exhausted bath of the preceding dyeing (Example 10).

Color: dark brown
0.66% C.I. Acid Yellow 219—yield 100
0.27% C.I. Acid Red 57—yield 100
0.41% C.I. Acid Blue 72—yield 100
0.75% Agent ATSA B—Althouse
0.5% Matexil LC-CWL—ICI
0.25 g/l Ammonium Sulphate
0.15 cc/l 36° Bè Caustic Soda
pH after adding the ammonium sulphate=8.5
Final pH=8

The dyeing diagram and the operations are the same as in Example 8.

We claim:

1. A process for dyeing quick dyeing synthetic polyamides consisting essentially of dyeing said polyamides in a bath containing acid dyes, an ammonium salt and an alkali metal hydroxide, and having an initial pH between 8 and 9.5, and heating said bath to a final temperature of 60° C., said alkali metal hydroxide and said ammonium salt being added in an amount sufficient to lower the pH of the bath, at the final temperature by 0.5-0.9.

2. The process according to claim 1, wherein said ammonium salt is ammonium sulphate and said alkali metal hydroxide is caustic soda.

3. The process according to claim 2, wherein the bath contains from 0.12 to 0.5 cc/l. of 36° Be caustic soda and from 0.3 to 0.5 g/l of ammonium sulphate, in water purified by ion exchange.

4. The process according to claim 1, wherein anionic and cationic levelling agents are added to the bath.

5. The process according to claim 1, wherein the bath is heated at a constant temperature gradient from its initial to its final temperature.

6. The process according to claim 1, wherein the total duration of the dyeing, starting from the introduction of the dyes, does not exceed two and half an hours.

7. The process according to claim 1, wherein the dyeing is started at a temperature of about 20° C.

8. The process according to claim 1, wherein the dyeing is carried out in an apparatus suitable for exhaustive dyeing.

9. The process according to claim 8, wherein the dyeing is carried out in a winch dyeing apparatus.

10. The process according to claim 1, wherein the exhausted bath of the dyeing cycle is used for successive dyeing cycles, with the addition of the required dyestuffs and of the amount of reagents required to produce the desired initial pH of the bath.

11. The process according to claims 8 or 9, wherein the dyeing cycles following the first one are started at a temperature from about 20° to 40° C.

12. The process according to claim 10, wherein the dyestuffs, a levelling agent and the caustic soda are added to the bath and the same is maintained at a temperature from about 20° to 40° C. for about 10 minutes, and thereafter the ammonium sulphate is introduced, the amount of caustic soda and of ammonium sulphate being such as to obtain the desired initial pH, and the bath is heated until the desired final temperature is reached.

13. The process according to claims 8 or 9, wherein the dyed material is rapidly withdrawn from the dye bath in the dyeing cycle and rapidly cooled.

14. The process according to claim 1, wherein the textile material is substantially constituted by polycapronamide (Nylon 6).

15. The process according to claim 1, wherein said polyamide is in the form of a carpet.

16. The process according to claim 1, wherein combinations of said acid dyes are used.

17. The process according to claim 1, which comprises adjusting the bath to about room temperature, then heating the bath in two steps, initially slowly then more rapidly until the desired final temperature is reached, said heating being followed by a holding of the bath at said final temperature.

* * * * *